US005941799A

United States Patent [19]

Bergdorf

[11] Patent Number: 5,941,799

[45] Date of Patent: Aug. 24, 1999

[54] HAND, WRIST AND FOREARM EXERCISE DEVICE

[76] Inventor: Nelson G. Bergdorf, 5413 Mahogany La., Roscoe, Ill. 61073

[21] Appl. No.: 08/989,128

[22] Filed: Dec. 11, 1997

[51] Int. Cl.[6] ..... A63B 23/12; A63B 21/045

[52] U.S. Cl. ..... 482/44; 482/45; 482/126; 482/127

[58] Field of Search ..... 482/44, 45, 126, 482/127, 128, 46

[56] References Cited

U.S. PATENT DOCUMENTS

| | | | |
|---|---|---|---|
| 1,023,756 | 4/1912 | Pons | 482/126 |
| 2,106,994 | 2/1938 | Chapman | 482/126 |
| 2,818,253 | 12/1957 | Zito | 482/46 |
| 4,095,789 | 6/1978 | Mueller | 482/127 |
| 4,345,757 | 8/1982 | Lo Voi | 482/132 |
| 4,770,409 | 9/1988 | Wallisch . | |
| 4,805,899 | 2/1989 | Roehlk | 482/45 |
| 4,838,542 | 6/1989 | Wilkinson | 482/45 |
| 5,046,727 | 9/1991 | Wilkinson et al. | 482/45 |
| 5,267,921 | 12/1993 | Roehlk | 482/127 |
| 5,380,259 | 1/1995 | Robertson et al. . | |
| 5,490,817 | 2/1996 | Stander et al. . | |
| 5,643,158 | 7/1997 | Clementi | 482/127 |

*Primary Examiner*—Richard J. Apley
*Assistant Examiner*—Victor K. Hwang
*Attorney, Agent, or Firm*—David L. Volk

[57] ABSTRACT

A spring is disposed longitudinally within a tubular body. Two t-shaped handles each comprise a central leg and two opposed arms extending outwardly from the central leg. The central legs of the handles are rotatably connected to opposing ends of the body such that the opposed arms are perpendicular to the body. A retaining pin is connected to each end of the spring. Each retaining pin is disposed within one of the handles and extends between and within the two opposed arms. The handles urge against the retaining pin within the handle to twist the spring about a longitudinal axis of the spring when the handles are manually rotated.

4 Claims, 3 Drawing Sheets

HAND, WRIST AND FOREARM EXERCISE DEVICE

BACKGROUND OF THE INVENTION

1. Field of the Invention

The present invention relates to exercise devices, particularly to devices which exercise the hands, wrists and forearms.

2. Description of the Related Art

Hand, wrist and forearm exercisers tend to be complicated in structure and cumbersome to use. What is needed is a device which is simply constructed and therefore inexpensive, simple to use, and portable.

SUMMARY OF THE INVENTION

The exercise device of the present invention includes a spring disposed longitudinally within a tubular body. Two t-shaped handles each comprise a central leg and two opposed arms extending outwardly from the central leg. The central legs of the handles are rotatably connected to opposing ends of the body such that the opposed arms are perpendicular to the body.

A retaining pin is connected to each end of the spring. Each retaining pin is disposed within one of the handles and extends between and within the two opposed arms. The handles urge against the retaining pin within the handle to twist the spring about a longitudinal axis of the spring when the handles are manually rotated. The body, the handles and the retaining pins may be simply constructed from plastic piping.

Still further features and advantages will become apparent from the ensuing description and drawings.

DETAILED DESCRIPTION

Figure 1:
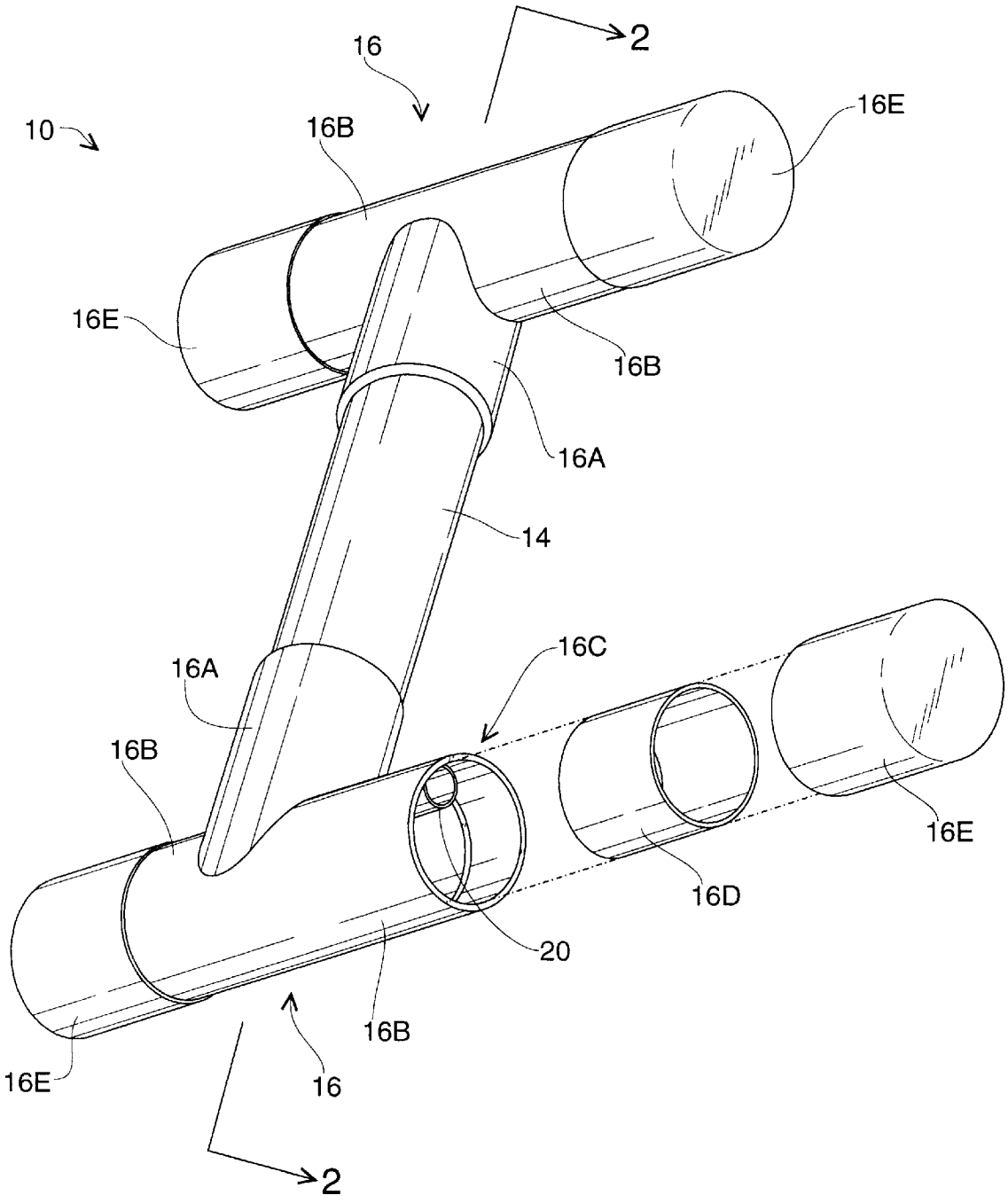
FIG. 1 is a partially exploded perspective view of an exercise device of the present invention.
Figure 2:
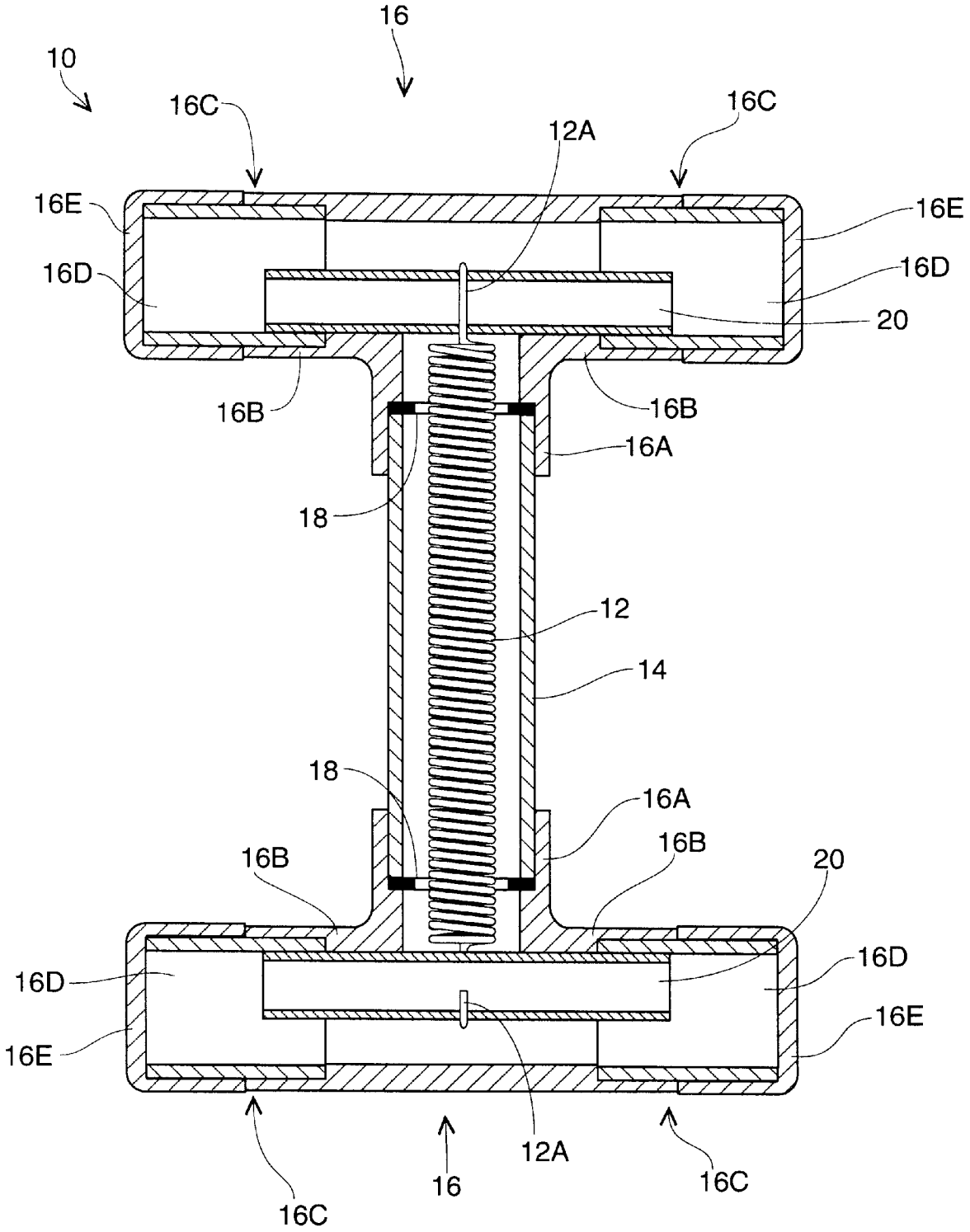
FIG. 2 is a cross-section of the device taken along line 2—2 of FIG. 1.

FIG. 1 is a partially exploded perspective view of an exercise device 10 of the present invention. FIG. 2 is a cross-section of the device 10 taken along line 2—2 of FIG. 1. Referring to FIGS. 1 and 2, the device 10 includes a spring 12 disposed longitudinally within a tubular body 14. Two t-shaped handles 16 each comprise a central leg 16A and two opposed arms 16B extending outwardly from the central leg 16A.

The central legs 16A of the handles are rotatably connected to opposing ends of the body 14 such that the opposed arms 16B are perpendicular to the body 14. Friction reducing means 18 such as smooth washers or bearings permit smoother rotation of the handles 16 relative to the body 14. The ends 16C of the opposed arms 16B are finished with sleeves 16D and caps 16E.

A retaining pin 20 is connected to hooks 12A at each end of the spring 12. Each retaining pin 20 is disposed within one of the handles 16 and extends between and within the two opposed arms 16B. The handles 16 urge against the retaining pin 20 within the handle 16 to twist the spring 12 about a longitudinal axis of the spring 12 when the handles 16 are manually rotated. The body 14, the handles 16 and the retaining pins 20 may be simply constructed from plastic piping.

Figure 3:
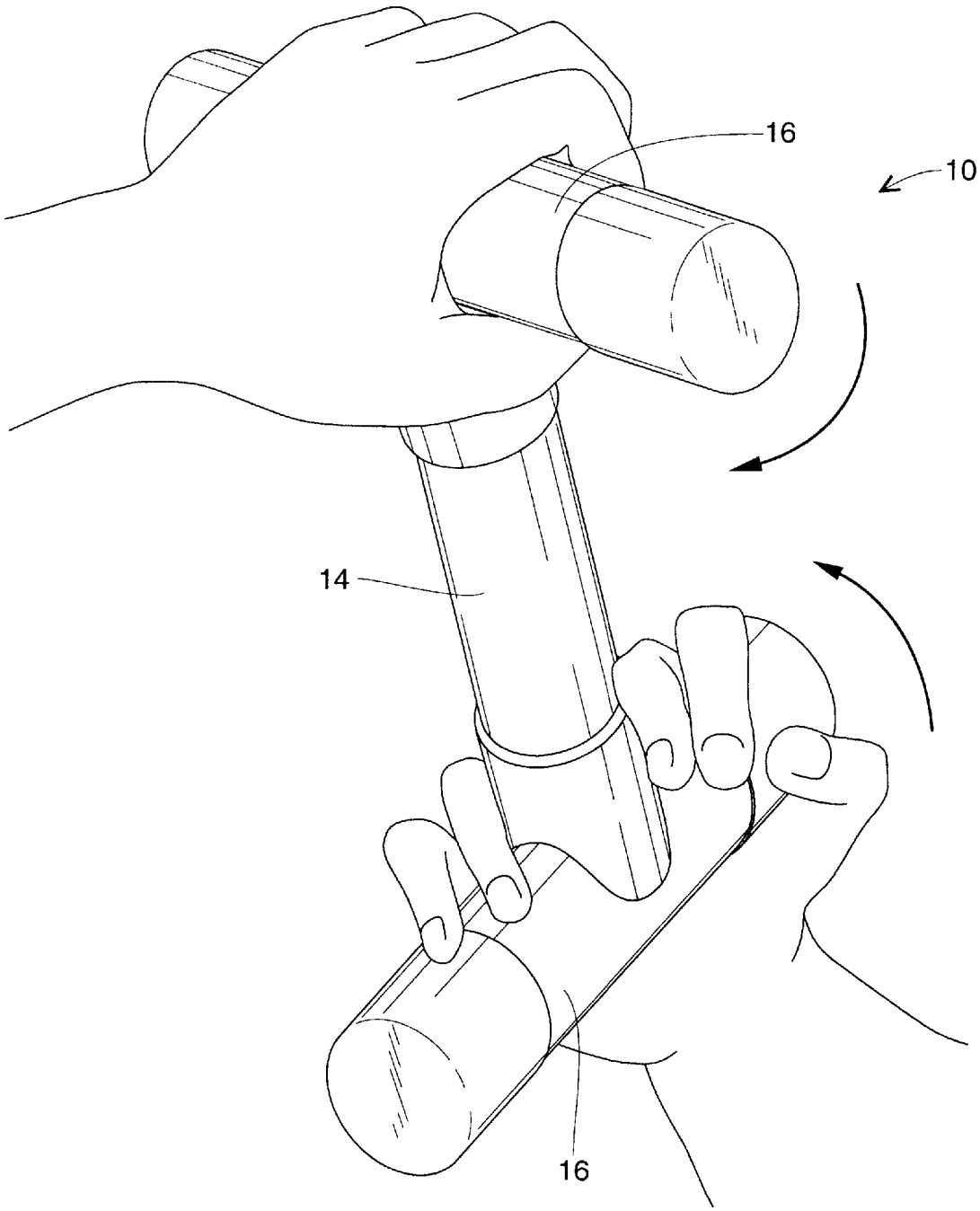
FIG. 3 is a perspective view of the device in use.

FIG. 3 is a perspective view of the device 10 in use. A person grips each handle 16 in a hand and rotates the handles 16 in opposing directions as indicated by the arrows, to exercise the hands, wrists and forearms.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention.

For example, and not by way of limitation, the retaining pins 20 may be connected to the handles 16, or the spring 12 may be directly connected to the handles 16. Additionally , the handles 16 may be wheel shaped instead of t-shaped.

Accordingly, the scope of the invention is to be limited only by the following claims and their legal equivalents.

The invention claimed is:

1. An exercise device comprising:

a. a generally tubular body;

b. a spring disposed longitudinally within the body;

c. a handle at each end of the body;

d. a retaining pin connected to each end of the spring, each retaining pin disposed within one of the handles;

e. each handle configured to urge against the retaining pin within the handle to twist the spring about a longitudinal axis of the spring when the handle is manually rotated;

f. the handles being t-shaped;

g. each handle comprising a central leg and two opposed arms extending outwardly from the central leg, the central legs of the handles rotatably connected to opposing ends of the body such that the opposed arms are perpendicular to the body; and h. each retaining pin extending between and within the two opposed arms of the handle which contains the retaining pin.

2. The exercise device of claim 1, wherein the body, the handles and the retaining pin are constructed of plastic piping.

3. An exercise device comprising:

a. a generally tubular body;

b. a spring disposed longitudinally within the body;

c. a handle at each end of the body;

d. each handle configured to twist the spring about a longitudinal axis of the spring when the handle is manually rotated; and e. the spring urging the handles inward until the body restricts the handles from further inward movement.

4. The exercise device of claim 3, further comprising a friction reducing means to reduce friction when the handles are rotated relative to the body.

* * * * *